United States Patent [19]

Giuffrida

[11] Patent Number: 4,459,820

[45] Date of Patent: Jul. 17, 1984

[54] MOTOR-DRIVEN COMPRESSOR-CONDENSER GROUP FOR COOLING CYCLES

[75] Inventor: Giorgio G. Giuffrida, Pavia, Italy

[73] Assignee: NECCHI Societa per Azioni, Pavia, Italy

[21] Appl. No.: 393,888

[22] Filed: Jul. 1, 1982

[30] Foreign Application Priority Data

Jul. 13, 1981 [IT] Italy ..... 42914 A/81

[51] Int. Cl.[3] ..... F25B 27/02

[52] U.S. Cl. ..... 62/238.6; 62/508

[58] Field of Search ..... 62/238.6, 508; 417/901, 417/902

[56] References Cited

U.S. PATENT DOCUMENTS

| | | | |
|---|---|---|---|
| 1,934,604 | 11/1933 | Kucher | 62/508 X |
| 2,205,138 | 6/1940 | Gould | 62/508 X |
| 2,597,745 | 5/1952 | Morrison | 62/238.6 X |
| 2,668,420 | 2/1954 | Hammell | 62/238.6 X |

FOREIGN PATENT DOCUMENTS

| | | | |
|---|---|---|---|
| 252634 | 4/1963 | Australia | 62/238.6 |
| 821079 | 9/1959 | United Kingdom | 62/238.6 |

*Primary Examiner*—Lloyd L. King

*Attorney, Agent, or Firm*—Stevens, Davis, Miller & Mosher

[57] ABSTRACT

A motor-driven compressor condenser group for equipment actuating cooling-cycles, such as for example cooling apparatuses and heat pumps, enclosed in a single container.

The cooling fluid of the heat-exchanger connected to the condenser passing to and from the container is to be used in domestic cooling systems to heat water.

1 Claim, 2 Drawing Figures

MOTOR-DRIVEN COMPRESSOR-CONDENSER GROUP FOR COOLING CYCLES

The present invention relates to a motor-driven compressor-condensor group for cooling cycles used in cooling apparatuses and in systems with heat pumps.

The motor-driven compressor and the condenser are, in such applications, separate and disposed in different positions. This leads to a certain difficulty in the stage of mounting the apparatuses, in that it is necessary to perform a certain number of operations for the separate application of the condenser, the motor-driven compressor and for the connecting-up of the elements.

The present invention proposes a particular technical solution for reducing the processing times and costs in volume production of cooling apparatuses, which solution is characterized by the fact that the condenser is enclosed within the hermetically sealed container of the motor-driven compressor, and in close proximity to the compressor.

A further advantage is represented by economy in the material used in the integrated component consisting of a condenser-motor-driven compressor. A single container is, for example, sufficient for the two elements.

Also of not negligible importance is the advantage of being able to achieve with the solution according to the invention a considerable thermodynamic gain resulting from the more efficient removal of compression heat by cooling fluid.

In applications employing heat pumps, the yield of compression heat is particularly opportune when a part of the heat, normally dispersed into the environment, is yielded to the liquid to be heated.

Other advantages and characteristics will be seen from the following description of a preferred embodiment of the motor-driven compressor-condenser group forming subject matter of the present invention and from the attached drawings in which.

Figure 1:
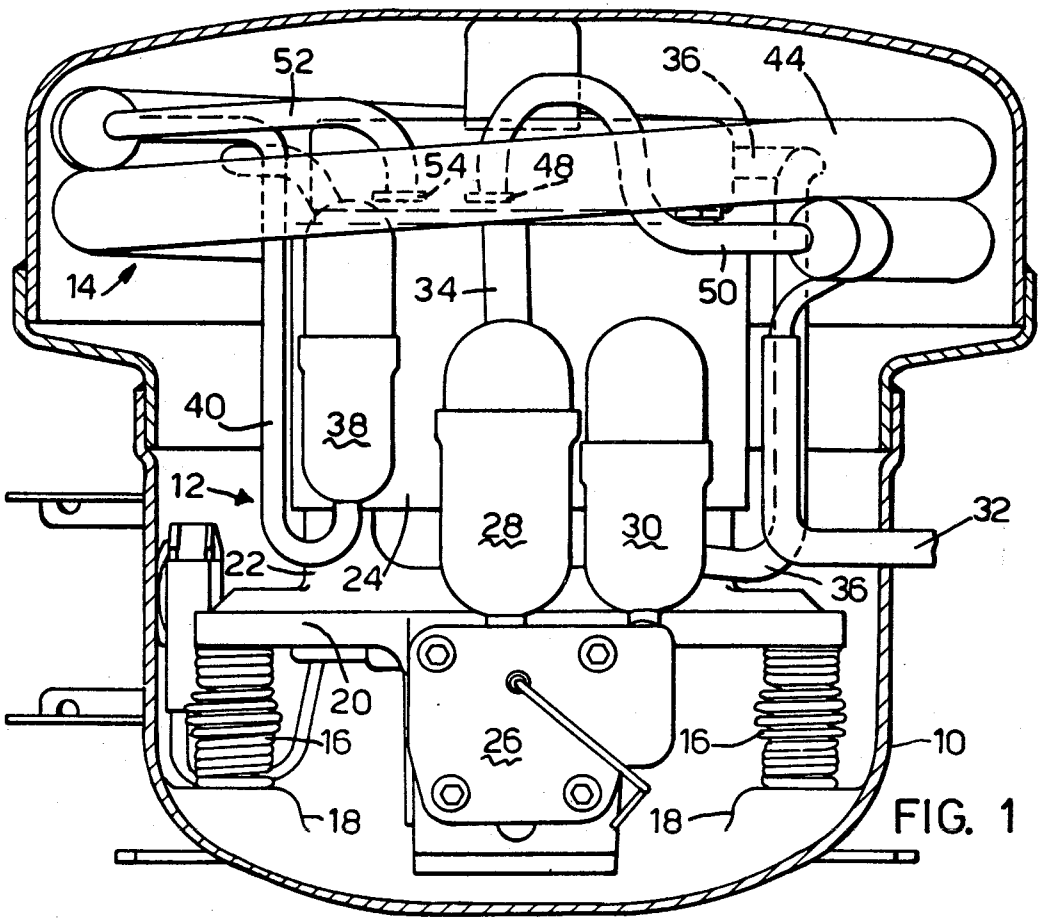
FIG. 1 is a frontal view of the apparatus described.
Figure 2:
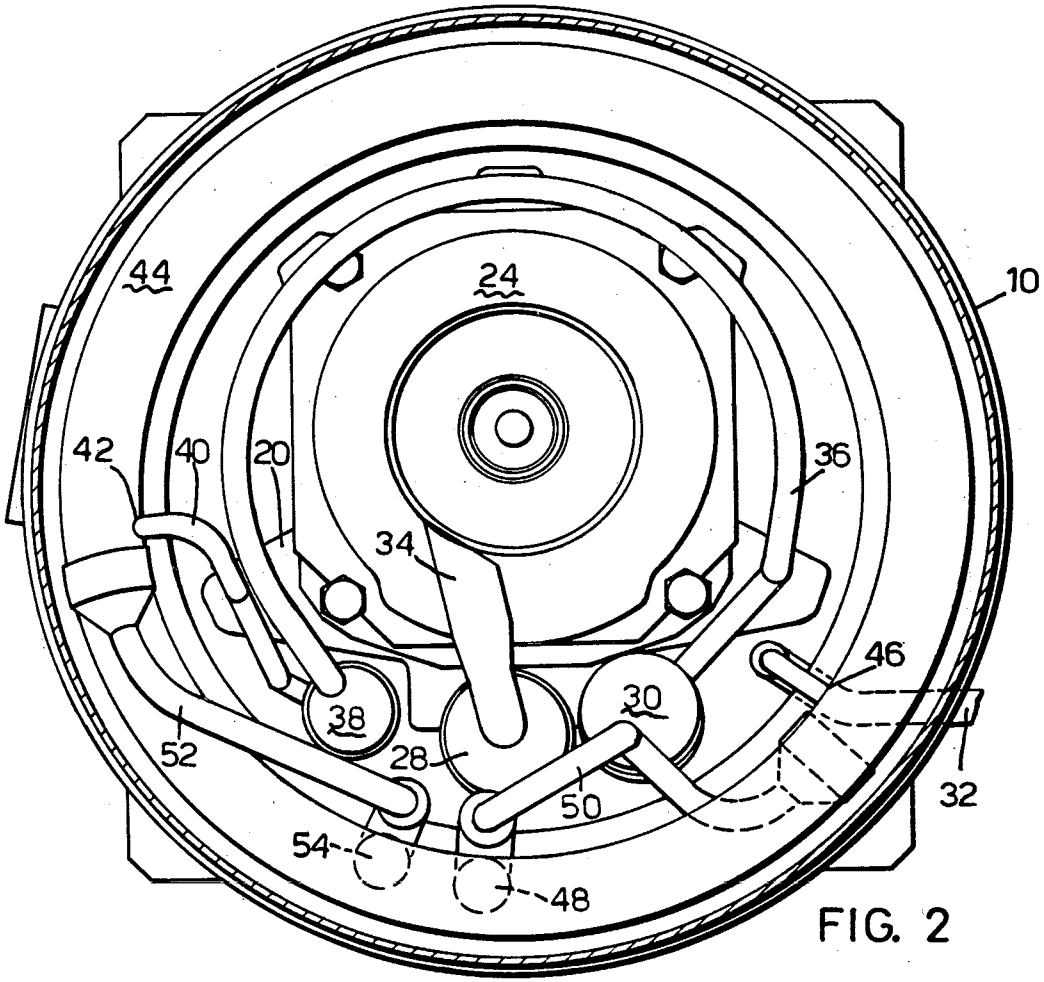
FIG. 2 is a plan view of the apparatus of FIG. 1.

With reference to FIG. 1, the reference number 10 indicates the container which hermetically encloses the motor-driven compressor 12 and the condenser 14 which, in the preferred embodiment represented in the drawings, is positioned in the upper part of the container.

The motor-driven compressor 12 is supported in the container by means of helical springs 16 which rest against support elements 18 and are connected in the upper portion to the body 20 of the motor-driven compressor which, in turn, supports the stator 24 by means of the columns 22. In the lower part of the motor-driven compressor there is formed the head 26 of the cylinder of the compressor, within which head are formed the aspiration chamber and the delivery chamber, not shown in the Figures.

Provision is made for two silencers 28 and 30 communicating with the chambers and on the aspiration and delivery duct respectively.

The condenser 14 is supported by customary means, not shown in the drawings, within the upper wall of the container 10, which is of larger diameter than the underlying part and consists of a tube 44 which winds spirally in the area of the peripheral part of the container.

The condenser is a heat-exchanger of known commercial type consisting of an internal tube within which flows cooling fluid to be cooled, and of a concentric external tube within which a cooling fluid flows counter-currently to the flow of the cooling medium.

The cooling gas which occupies the container is aspirated by the motor-driven compressor in the aspiration chamber formed in the head 26 through an end of the tube 34, the opposed end of which is inside the silencer 28.

From the silencer 28 the gas passes into the aspiration chamber of the head 26. From there it is aspirated into the cylinder and then compressed through the delivery chamber, the silencer 30, the tube 36 which accomplishes an almost complete arc of circumference before entering the supplemental silencer 38 from which the gas exits in the lower portion through the small tube 40. Tube 40 penetrates at 42 the tube 44 forming the heat-exchanger. The tube 44 is spirally wound for almost two winds in the upper part of the container 10.

At the end of the spiral, the small tube containing the compressed freon in liquid phase exits at 46 from the tube 44, proceeds downwardly in the tube 32 and leaves the container to proceed in its course towards the evaporator (not shown in the drawings).

In order to cool the freon a cooling fluid is caused to circulate counter-currently to it, and in the tube 44. The cooling fluid enters the container 10 at 48 and is carried by the tube section 50 into the tube 44.

The cooling fluid leaves the tube 44 at the opposite end thereof and, through the tube 52, leaves the container at 54.

The motor-driven compressor-condenser unit forming subject matter of the present invention finds a particular application in domestic cooling apparatuses in which the condenser discharge heat is recovered to heat water for domestic use.

What is claimed is:

1. A motor-driven compressor-condenser group for cooling cycles, comprising a hermetically sealed refrigerant container, a condenser comprising a heat exchanger, a motor and a motor-driven compressor, said condenser, motor and compressor being mounted witin said container, said condenser being in close proximity to the compressor, including a counter currently fluid flowing apparatus concentrically mounted about said heat exchanger and within said container and having an inlet and outlet external of said container so that the discharge heat of the cooling liquid of the heat exchanger connected to the condenser is recovered, in domestic cooling apparatuses, to heat water.

* * * * *